US006443617B2

(12) United States Patent
Tetenborg

(10) Patent No.: US 6,443,617 B2
(45) Date of Patent: Sep. 3, 2002

(54) RESEALABLE SACK OR BAG

(75) Inventor: Konrad Tetenborg, Lengerich (DE)

(73) Assignee: Windmoeller & Hoelscher, Lengerich (DE)

( * ) Notice: Subject to any disclaimer, the term of this patent is extended or adjusted under 35 U.S.C. 154(b) by 0 days.

(21) Appl. No.: 09/761,722

(22) Filed: Jan. 18, 2001

(30) Foreign Application Priority Data

Jan. 18, 2000 (DE) ..... 100 01 824

(51) Int. Cl.[7] ..... B65D 33/10

(52) U.S. Cl. ..... 383/7; 383/77; 383/88; 383/89

(58) Field of Search ..... 383/7, 77, 88, 383/89, 91

(56) References Cited

U.S. PATENT DOCUMENTS

| | | | | | |
|---|---|---|---|---|---|
| 2,855,137 | A | * | 10/1958 | Simonsen | 383/98 X |
| 3,052,399 | A | * | 9/1962 | Brown | 383/77 X |
| 3,203,551 | A | * | 8/1965 | Van Loan, Jr. | 383/89 X |
| 3,217,971 | A | * | 11/1965 | Shvetz | 383/77 X |
| 3,774,838 | A | * | 11/1973 | Christie | 383/77 |
| 4,859,082 | A | * | 8/1989 | Llorens et al. | 383/77 X |
| 4,937,410 | A | * | 6/1990 | Anderson | 383/77 X |
| 4,946,289 | A | | 8/1990 | Bolling et al. | |
| 5,348,399 | A | | 9/1994 | DeMatteis | |
| 5,407,419 | A | * | 4/1995 | Kelly et al. | 383/77 X |
| 5,720,557 | A | * | 2/1998 | SImonsen | 383/77 X |
| 5,908,244 | A | * | 6/1999 | Galambos | 383/77 X |
| 6,183,132 | B1 | * | 2/2001 | Simhaee | 383/77 X |

FOREIGN PATENT DOCUMENTS

| | | | | |
|---|---|---|---|---|
| EP | 000519896 | * | 12/1992 | 383/77 |
| JP | 0018201 | * | 1/1990 | 383/77 |

* cited by examiner

*Primary Examiner*—Jes F. Pascua
(74) *Attorney, Agent, or Firm*—Jacobson Holman, PLLC

(57) ABSTRACT

A sack or bag is made of a collapsed, thermoplastic tubular film segment, which is provided preferably with side folds, by affixing head and foot welds and is provided on at least its head side with corner-partitioning corner welds. In order to be able to reseal such a sack after a partial quantity has been removed from its filling, the corners are provided in such a manner with cutouts, starting from the face-sided cutting edge, that the results are side strips, whose outer ends are provided with redetachable connecting means and that are designed so long that they can be folded in the outward direction by folding diagonally over the side edges of the sack or bag. After formation of a sack-sealing roll, the connecting means can be connected together for the purpose of fixing the roll in position.

18 Claims, 3 Drawing Sheets

RESEALABLE SACK OR BAG

BACKGROUND OF THE INVENTION

1. Field of the Invention

The invention relates to a resealable sack or bag, which is made of a collapsed, thermoplastic tubular film segment, which is provided preferably with side folds, by affixing head and foot welds and is provided on at least its head side with corner-partitioning corner welds.

2. Description of the Related Art

Such sacks or bags exist; and hence there is no need to describe them in detail. If the sacks or bags have been made from tubular segments provided with side folds, they assume an essentially square shape after they have been filled. Such sacks or bags are often used to package and store bulk materials, of which only a partial quantity is removed after the sack has been opened so that there is the problem of resealing the sacks or bags until the next partial quantity is removed.

SUMMARY OF THE INVENTION

Therefore, the object of the invention is to provide a sack or bag of the class described in the introductory part that is economical to produce and can be resealed in an easy to handle manner once the bag or sack has been opened.

The invention solves this problem in that the corners are provided in such a manner with cutouts, starting from the face-sided cutting edge, that the results are side strips, which form preferably handle straps and whose outer ends are provided with redetachable connecting means and that are designed so long that they can be folded in the outward direction by folding diagonally beyond the side edges of the sack or bag.

Sacks or bags of the class described in the introductory part are usually opened by severing the head weld, sealing the sack, with a cut parallel to said head weld. If a partial quantity is removed from such an opened sack or bag, the side walls and optionally the side folds of the bag can be laid flat until said bag is filled and then closed by rolling up. After forming this roll, however, it must be fixed in position in order to prevent it from an undesired unrolling, a feature that is usually solved with adhesive strips or clamps. In the case of the sack or bag, according to the invention, the rolled up opening side can be bent or curled around the central axis of the sack or bag so that the strips, which are provided with the redetachable connecting means and which project laterally beyond the rolled up opening side of the bag, can be connected together so that the roll, sealing the bag, is fixed in position.

Expediently the redetachable connecting means comprise VELCRO hook and loop fasteners, permanently tacky remaining layers, snap fasteners or strings.

If permanently tacky remaining layers are provided, they are preferably covered with peelable layers up until the time they are first connected together.

If the connecting means comprise strings, the strips, connected to them, do not have to project beyond the roll, sealing the sack, because a seal can be achieved by merely knotting the strings. If the seal is accomplished with the use of strings, they do not have to be connected to the strips, but rather it suffices to connect them to one side of the sack or bag.

BRIEF DESCRIPTION OF THE DRAWINGS

One embodiment of the invention is explained in detail below with reference to the drawings.

DETAILED DESCRIPTION OF THE PREFERRED EMBODIMENTS

Figure 1:
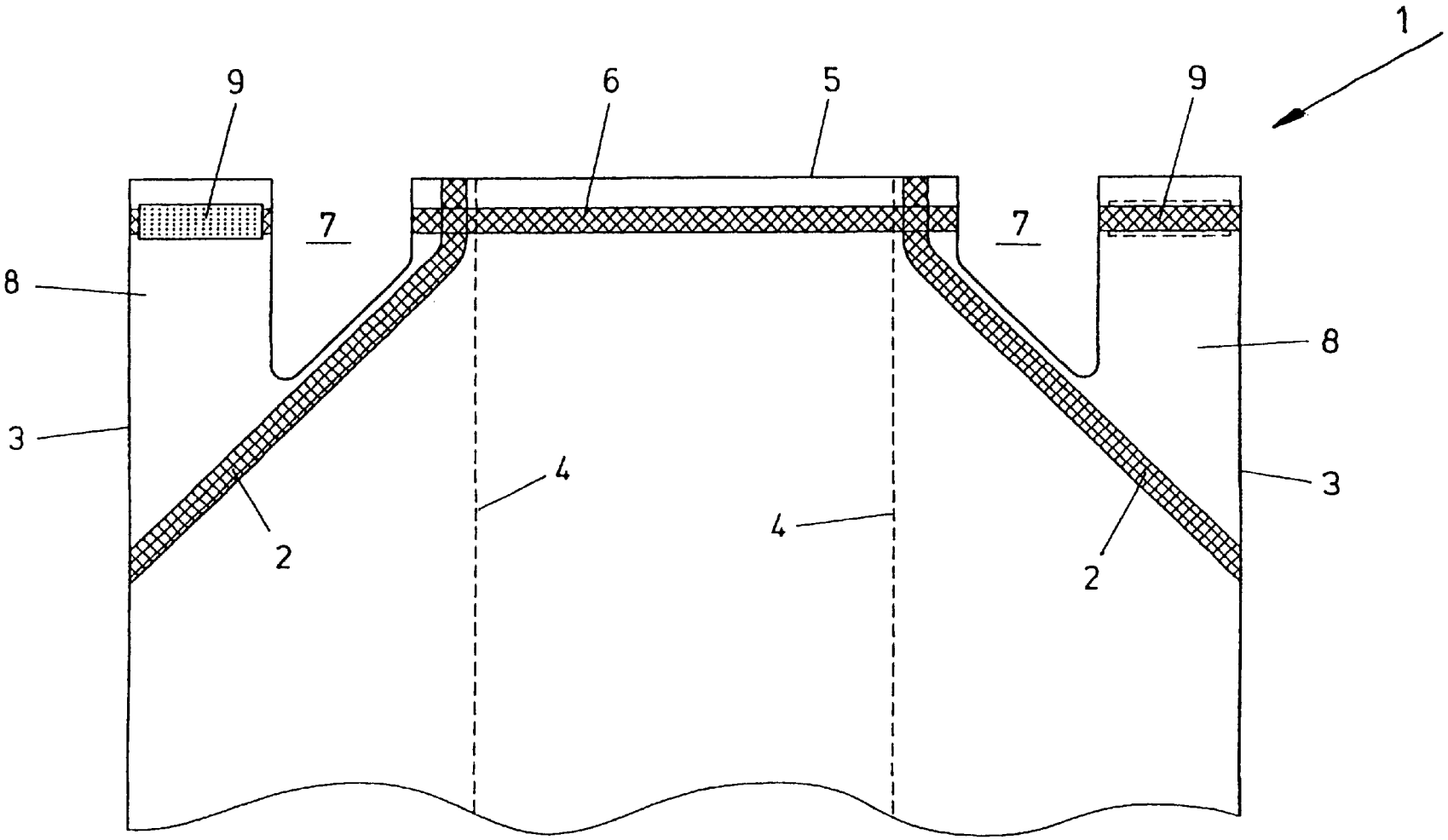
FIG. 1 depicts the opening side of a side fold sack of the invention in the collapsed state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The resealable side fold sack, depicted in the drawings, is made of a thermoplastic tubular film segment, which is provided with side folds, and which is provided (in a manner that is not illustrated in detail) with a bottom and on the head side with corner-partitioning corner welds 2, which run at a 45° angle relative to the side edges 3 and seize only one of the two side folds, and hence are not connected together. The corner welds 2 terminate in front of the inside folding edges 4 of the side folds. They run at approximately right angles into the upper cutting edges 5 of the tubular segments so that it is guaranteed that the sack-sealing head welds 6 cross the corner welds in the illustrated manner. The head welds 6 are also designed continuous through the corners, partitioned off by the corner welds 2. The corners, provided with the head welds 6, are provided in the illustrated manner with cutouts 7, which separate the peripheral strips 8, which extend freely from the corners.

These peripheral strips 8 can be used as handle straps, since they are connected together on the head side and can be grasped from the side.

In the region of their upper ends the peripheral strips 8 are connected to strips 9, made of VELCRO hook and loop fasteners.

Figure 2:
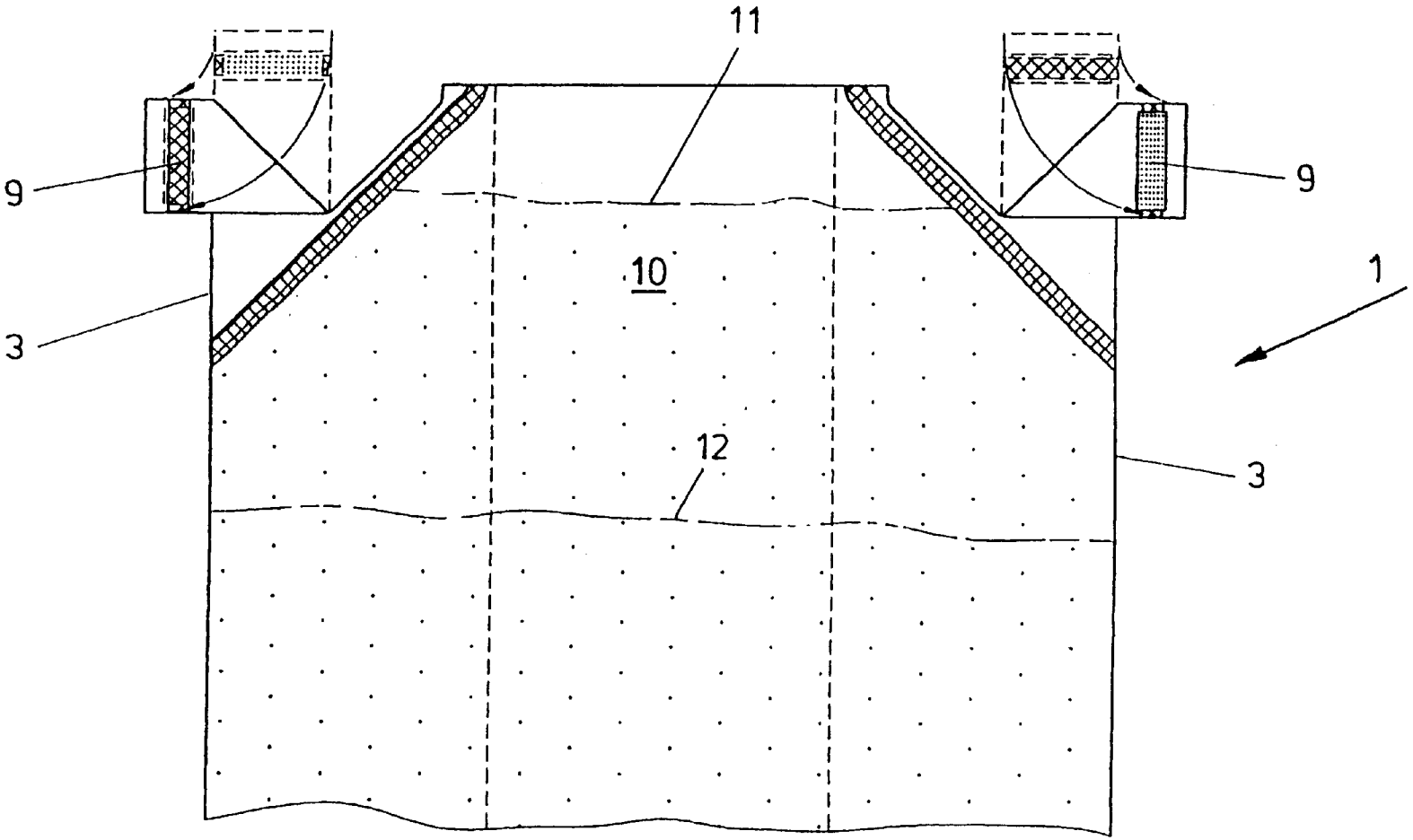
FIG. 2 depicts the sack, according to FIG. 1, after it has been opened, and schematically indicated fill states and outwardly folded strips, serving to fix into position the roll, sealing the sack.
Figure 3:
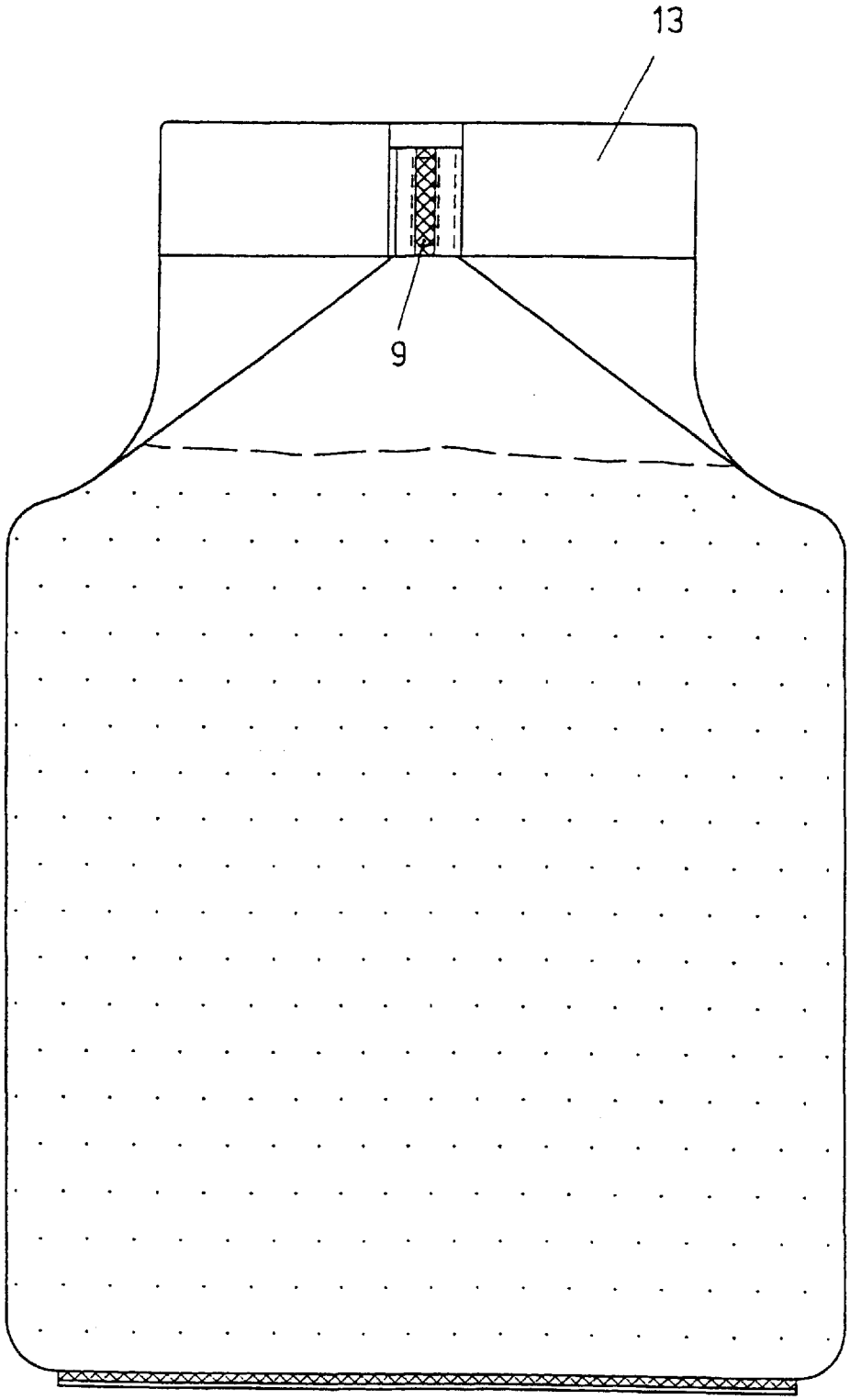
FIG. 3 is a side view of the sack, according to FIGS. 1 and 2, after removal of a partial quantity of its filling in the resealed state.

FIG. 2 depicts the sack, according to FIG. 1, in various fill states, and for the sake of a better overview in the collapsed state, even though the sack assumes, of course, a different, namely square shape in its filled state. To open said sack, the upper part, provided with the sealing weld 6, is severed from the sack in the manner, apparent from FIG. 2. After the sack has been opened, the sack exhibits an upper fill state 11. After a partial quantity of the material 10 has been removed, the fill state in the sack drops to the level 12. The upper sack end that has become free thereby can now be rolled up in the conventional manner for the purpose of sealing. Prior to rolling up, the strips, bearing the VELCRO hook and loop fasteners 9, are folded in the outward direction at an angle of about 45° so that the VELCRO hook and loop fastener strips project beyond the outer edges of the sack 3. If the sack seal is formed by rolling up the sack end, the sack-sealing roll 13 can be united in the shape of a ring by curling or bending around the central axis of the sack in such a manner that the VELCRO hook and loop fasteners 9 can be attached to each other in order to secure the rolling up that seals the sack.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A resealable bag, comprising:

a thermoplastic tubular film segment having a head weld, a cutting edge extending substantially parallel to said head weld, side edges and two corners, each of said corners provided with a cutout which starts from said cutting edge to create a side strip on each corner, each of said side strips having a length that can be folded diagonally outwardly beyond said side edges;

corner-partitioning corner welds crossing over and extending from said head weld to a respective side edge of said bag; and a connecting element attached to an outer end of each of said side strips for attaching to each other to reseal said bag when said head weld is removed and said strips are diagonally folded and rolled together.

2. The bag as set forth in claim 1, wherein said side strips with connecting elements are diagonally folded in the outward direction at an angle of approximately 45°.

3. The bag as set forth in claim 1, wherein said bag includes two side folds having inside folding edges, respective upper portions of said corner welds terminating in front of said inside folding edges.

4. The bag as set forth in claim 3, wherein said upper portions of said corner welds intersect with said head weld at a substantially 90° angle, and lower portions of said corner welds angle toward said side edges.

5. The bag as set forth in claim 4, wherein said lower portions of said corner welds meet said side edges at a substantially 45° angle.

6. The bag as set forth in claim 3, wherein each corner weld seizes only one of said two side folds.

7. The bag as set forth in claim 1, wherein said connecting elements include redetachable hook and loop type fasteners.

8. The bag as set forth in claim 1, wherein said side strips are rolled together by curling said side edges around a central axis of said bag.

9. A resealable bag for bulk material made of a thermoplastic tubular film segment with side folds, comprising:

a head weld for initially sealing said bag;

a cutting edge running substantially parallel with said held weld for opening said bag;

side edges extending substantially perpendicular to said head weld;

two corners, each of which is provided with a cutout which creates a side strip on each corner, each of said side strips having a length that can be folded diagonally outwardly beyond said side edges;

corner welds crossing over and extending from said head weld to a respective side edge of said bag, said corner welds extending beneath said cutouts such that fill material within said bag does not pass into said side strips; and a connecting element attached to each side strip for attaching to each other to reseal said bag when said head weld is removed and said side strips are diagonally folded and rolled together.

10. The bag as set forth in claim 9, wherein said side strips with connecting elements are diagonally folded in the outward direction at an angle of approximately 45°.

11. The bag as set forth in claim 9, wherein upper portions of said corner welds terminate in front of inside folding edges of said side folds.

12. The bag as set forth in claim 11, wherein said upper portions of said corner welds intersect with said head weld at a substantially 90° angle, and lower portions of said corner welds angle toward said side edges.

13. The bag as set forth in claim 12, wherein said lower portions of said corner welds meet said side edges at a substantially 45° angle.

14. The bag as set forth in claim 9, wherein each corner weld seizes only one of said side folds.

15. The bag as set forth in claim 9, wherein said connecting elements include redetachable hook and loop type fasteners.

16. The bag as set forth in claim 9, wherein said side strips are rolled together by curling said side edges around a central axis of said bag.

17. The bag as set forth in claim 9, wherein each of said cutouts extends from said cutting edge, an upper edge of each side strip being even with said cutting edge before said head weld is removed.

18. The bag as set forth in claim 9, wherein each connecting element is attached to an outer end of a respective side strip so that, when said side strips are diagonally folded said connecting elements extend beyond said side edges.

* * * * *